United States Patent [19]

Thierheimer, Jr.

[11] Patent Number: 4,925,497

[45] Date of Patent: May 15, 1990

[54] SOLVENT FOR PARAFFIN REMOVAL FROM OILFIELD EQUIPMENT

[75] Inventor: Charles L. Thierheimer, Jr., Corvallis, Oreg.

[73] Assignee: Petrolite Corporation, St. Louis, Mo.

[21] Appl. No.: 319,793

[22] Filed: Mar. 6, 1989

Related U.S. Application Data

[63] Continuation-in-part of Ser. No. 107,898, Oct. 13, 1987, abandoned, which is a continuation of Ser. No. 564,870, Dec. 23, 1983, abandoned.

[51] Int. Cl.[5] ..... C11D 7/00; C11D 7/50; C11D 7/60

[52] U.S. Cl. ..... 134/40; 106/311; 252/170; 252/8.552; 252/364

[58] Field of Search ..... 252/170, 8.552, 364; 106/311; 134/40

[56] References Cited

U.S. PATENT DOCUMENTS 3,167,514 1/1965 Baker ..... 252/170
3,718,586 2/1973 Rollo et al. ..... 252/8.552

*Primary Examiner*—Paul Lieberman
*Assistant Examiner*—Alexander Ghyka
*Attorney, Agent, or Firm*—Stanley M. Tarter

[57] ABSTRACT

Paraffin deposits on oilfield equipment, pipelines, tanks and the like are removed on contact with a solvent composition comprising a substantially pure aromatic hydrocarbon and an aliphatic and/or alicyclic hydrocarbon. The solvent composition may contain a surfactant.

9 Claims, No Drawings

SOLVENT FOR PARAFFIN REMOVAL FROM OILFIELD EQUIPMENT

REFERENCE TO RELATED APPLICATIONS

The present application is a continuation-in-part application of U.S. Patent Application Ser. No. 107,898, filed 1987 Oct. 13, which is a continuation application of U.S. Patent Application Ser. No. 564,870, filed 1983 Dec. 23.

BACKGROUND OF THE INVENTION

1. Field of the Invention

This invention relates to a composition and method useful in removing paraffin and paraffin-like materials from oilfield equipment and the associated environment, such as may occur on the face of the producing formation, in the pump, in the casing or the tubing of the well and in oil flowlines and pipelines, tank batteries, tank farms and the like.

In many oilfields, particularly in those which produce fairly waxy crudes, production is limited as a result of the deposition of paraffin and paraffin-like deposits in the formation as well as in the oil production, transportation and storage equipment. It is not uncommon that the flow of oil from a well is completely stopped due to paraffin deposition. Further, deposition of paraffin and paraffin-like materials in pipelines results in increased pumping and maintenance costs.

The need for removal of paraffin deposits from well production transportation and storage equipment is obvious. In some areas, wells decline in productivity at a more or less rapid rate because of the deposition of such deposits on the face of the producing formation. In other cases, the decline is sufficiently rapid that the wells must be serviced in some manner at a frequency ranging from several days to several weeks. In other instances, the paraffin deposition is at such a slow rate that servicing at long intervals is sufficient to maintain the well at a satisfactory level of production. The same is true of the various conduits in which the oil travels from the well to the refinery. The capacity of a conduit or circuit of cross-section is reduced greatly by paraffin deposition, usually well beyond the reduction expected from the ratio of effective cross-sectional area of the conduit and the fouled conduit. Where paraffin deposits occur on formation walls, well productivity may fall substantially to zero, especially in low-pressure fields. Pipe capacities are frequently reduced to a small fraction of their capacities when cleaned. Ultimately, such pipes may be found completely clogged by paraffinic deposits.

Various techniques have been employed for the removal of paraffin deposits from oil-producing formations and wells penetrating such formations. These techniques include the use of mechanical and heating devices, explosives and solvents. Various solvents which have been used to dissolve paraffins include, benzene, xylene, toluene, gasoline, carbon tetrachloride and carbon disulfide.

One of the most effective solvents for paraffins of widely differing compositions is carbon disulfide. The use of carbon disulfide is difficult and hazardous, however, since it is extremely toxic and flammable, having a low flashpoint (−30° C.) and auto-ignition temperature (approximately 102° C.).

2. Description of the Prior Art

U.S. Pat. No. 3,718,586 describes a solvent mixture of liquified petroleum gas (a mixture of lower alkanes) and a very small amount of a liquid aromatic hydrocarbon. In Column 2, lines 39–43 of this patent, it is taught that the lower alkane and the liquid aromatic hydrocarbon are present in the volume ratio of 100:1 to about 500:1 and ideally present in a volume ratio of between about 250:1.

U.S. Pat. No. 3,241,614 describes a process of removing hydrocarbon accumulations by contacting the hydrocarbons with a liquid mixture of a solvent and a surfactant. Various hydrocarbon solvents are mentioned, as is carbon disulfide.

U.S. Pat. No. 3,375,192 describes a mixture for cleaning oil wells which is composed of carbon disulfide and pentane.

U.S. Pat. No. 3,402,770 discloses a single-base solvent which is used to dissolve flow-restricting materials in oil wet equipment. The solvent is a solution comprising an organic solvent for oil and asphalt and a liquid having mutual solubility for oil and water. Carbon disulfide is disclosed as the preferred organic solvent for oil and asphalt.

U.S. Pat. No. 2,358,655 discloses a method of removing paraffin from oil well tubing by the use of a solvent emulsion which consists essentially of a wax solvent, a petroleum distillate and water. Carbon tetrachloride and carbon disulfide are disclosed as examples of wax solvents.

U.S. Pat. No. 2,356,254 discloses wax solvents which include aromatics, turpentine, chlorine-substituted aromatics, chlorine-substituted aliphatics, kerosene, carbon disulfide, carbon tetrachloride, gasoline, gas oil and petroleum extracts.

U.S. Pat. No. 2,753,939 discloses a solvent mixture composed of an aromatic hydrocarbon such as toluene and ether alcohol and dialkyl ether.

U.S. Pat. No. 3,241,614 discloses the cleaning of well drilling equipment using the mixture of two or more solvents and a surfactant. Solvents which are used include liquid hydrocarbons, liquid halogenated hydrocarbons, liquid amine substituted hydrocarbons and liquid oxygenated hydrocarbons including alcohols, ketones and acids. The liquid hydrocarbons may be aliphatic or aromatic in character. Specifically disclosed are solvents such as kerosene, gasoline, benzene, xylene, toluene, pentane, alkylene amines, dioxane, ketones, acetic acid, carbon disulfide and the like. It is disclosed that a mixture of two or more of the cited solvents may be used. Additionally, a surfactant is added to the solvent or solvent mixture. A preferred surfactant is an oxyethylene ether of an alkyl aryl compound, e.g., the oxyethylene ether of nonyl phenol.

U.S. Pat. No. 3,718,586 discloses a solvent for cleaning well bores which includes a liquified petroleum gas and a normally liquid aromatic hydrocarbon. It is disclosed that increased solvent properties are obtained by the addition of a liquid petroleum sulfonate as well as a surfactant and ethylene glycol.

The terms "paraffin" and "paraffin-like" as used throughout the specification refer to any material which is insoluble, sparingly soluble, or undispersible in crude oil under conditions of production. Thus, the paraffin deposit may contain high molecular weight aliphatic hydrocarbons, e.g., long chain alkanes and alkyl-substituted alkanes having at least about 20 carbon atoms, petroleum resins, asphaltic materials, aromatic hydrocarbons, mineral matter and the like. As will be understood by those skilled in the art, the composition of such deposits varies from one crude oil to another, from one field to another and from one oil well to another well in the same field.

In addition to solvent procedures, a variety of other procedures are being used to remove accumulations of paraffin materials. Most methods involve the use of the solvents described above or mechanical means to dissolve and wash out the accumulations. Over 50% of the cost of producing and marketing oil from producing wells is related to cleaning procedures acquired to dissolve and remove paraffin. The two most common techniques for affecting these cleaning procedures involve the use of mechanical scraping and hot oil flushing. The paraffin removed from well equipment by these techniques usually remains in a solid form or otherwise it quickly returns to a solid after treatment. This materials also tends to accumulate in flowlines and the like. Mechanical scraping, with specially designed instruments, is sometimes referred to as "knifing". Another physical process is that which involves passing a hot petroleum oil through the equipment in order to remove the paraffin. Unfortunately, the hot oil represents considerable cost in heating, pumping and the like and has a relatively low solvency for paraffin. Scraping is not applicable when removal of paraffin is required from pumps, valves and the like.

SUMMARY OF THE INVENTION

The present invention provides a novel solvent composition having a relatively high flashpoint and synergistic solvating action and an improved method for the removal of paraffin from oilfield production, transportation and storage equipment. The novel solvent composition comprises a mixture of two solvents, one of which is a substantially pure aromatic hydrocarbon and the other is a mixture of non-aromatic hydrocarbons. In accordance with the present invention, it has been found that the above-described solvent mixture, while retaining a relatively high flashpoint, will dissolve more paraffin than will the individual solvents of the combination. The improved method, described hereinafter, involves contacting paraffins with the novel solvent composition in order to thereby dissolve the paraffins and remove them from the equipment.

In another aspect of the present invention, surfactant is added to the novel composition to assist in dispersing the paraffin materials in the solvents.

In a further aspect of the present invention, it has been found that the paraffin solvating power of a poorer grade aromatic solvent, i.e., an aromatic solvent having substantial amounts of impurities contained therein, may be upgraded by combining such poor grade aromatic solvent with a mixture of liquid non-aromatics, e.g., aliphatic and alicyclic hydrocarbons.

DETAILED DESCRIPTION OF THE INVENTION

As described above, the present invention relates to a novel solvent composition and improved method for removing paraffin deposits from oilfield equipment.

The novel solvent composition of the present invention comprises a mixture of two solvents. One of the solvents is a substantially pure, mononuclear, aromatic hydrocarbon which may be substituted at one or more positions with a lower alkyl group, i.e., and alkyl group having from about 1 to about 4 carbon atoms and isomers thereof. Representative aromatic hydrocarbon solvents which may be used in the composition of the present invention include benzene, toluene, xylene, mesitylene, cumene, ethyl benzene, propyl benzenes, butyl benzenes, the cymenes, ethyl toluenes and the like.

The non-aromatic component of the composition of the present invention is a saturated linear or cyclic hydrocarbon or mixture thereof. Examples of the saturated aliphatic and/or alicyclic hydrocarbon solvents utilized in the composition of the present invention include naphtha, cyclohexane, decalin, heptane, octane, cyclooctane, cycloheptane and the like.

Preferred solvent combinations are toluene/naphtha, especially toluene/VM & P naphtha, cumene/VM & P naphtha, mesitylene/VM & P naphtha, xylene/VM & P naphtha, toluene/cyclohexane, toluene/cyclooctane and the like.

The solvent composition of the invention may be applied at ambient temperature or may be heated prior to or during application at a temperature below its boiling point. The composition is used by pumping down the well annulus, slugging in the flowline continuous injection and the like.

Ordinarily, the weight ratio of the aromatic component to the non-aromatic component is from about 10/90 to about 90/10, preferably from about 40/60 to about 60/40, especially about 45/55 to 55/45. A particularly useful ratio is 50/50.

The following examples illustrate specific, non-limiting embodiments of the invention, including the best mode of practice of the invention.

EXAMPLE 1

Various solvents and solvent combinations were tested to determine their ability to dissolve paraffin. The tests were conducted on a petroleum wax (SHELLWAX ®300, consisting of a mixture of n-alkanes) having a sharp cloud point in solvent solutions. Several different mixtures of the wax in the solvent to be tested were prepared, e.g., 4 grams wax per 100 grams solvent, 10 grams wax per 100 grams solvent, etc. The wax and solvent mixtures were heated and stirred until clear solutions resulted. The resulting solutions were rapidly cooled to within a few degrees above their expected cloud points and then slowly cooled at a rate of about 0.1° C. every 15 minutes until the cloud points became manifest. Line graphs of cloud point temperatures versus grams wax per 100 grams solvent were prepared. The points where the line graph crosses the 38° C. axis correspond to cloud points at 38° C. and are referred to herein as the values of the Solvent Index @38° C.

The results are summarized in Table I, below:

TABLE I

| Solvent | Flashpoint °C. | GMS Paraffin Dissolved Per 100 GMS Solvent |
|---|---|---|
| Pentane | <−48 | 8.94 |
| Hexane | −22 | 8.04 |
| Heptane | −4 | 9.26 |
| Cyclohexane | −20 | 22.18 |
| Pentane/Heptane (50/50) | <−48 | 9.94 |
| Cyclooctane | — | 13.01 |
| Decalin | 58 | 10.74 |
| α-Pinene | — | 6.12 |
| Isooctane | — | 3.88 |
| Naphtha (Shell EC) | 13 | 9.43 |
| Toluene | 5 | 8.52 |
| Xylene | 30 | 7.80 |
| Tetralin | 71 | 3.83 |
| Toluene/Heptane (50/50) | — | 12.42 |
| Toluene/Decalin (50/50) | — | 12.66 |

TABLE I-continued

| Solvent | Flashpoint °C. | GMS Paraffin Dissolved Per 100 GMS Solvent |
|---|---|---|
| Toluene/Cyclooctane (50/50) | — | 16.15 |
| Toluene/Naphtha (50/50) | — | 12.44 |
| Carbon Disulfide | −30 | 36.58 |
| Toluene/Cyclohexane/ Naphtha (50/25/25) | — | 15.95 |
| Cyclohexane/Toluene/ Naphtha (50/25/25) | — | 15.94 |

The data shows that carbon disulfide is the best solvent for paraffin illustrated in the above table. As stated above, however, carbon disulfide is toxic and has a low flashpoint and therefore dangerous in use. Note that the compositions of the invention are characterized by a higher flashpoint and have greater solvation ability than either of its components when used alone, e.g., toluene, heptane, versus toluene/heptane; toluene decalin versus toluene/decalin; toluene, cyclooctane versus toluene/-cyclooctane; toluene, naphtha versus toluene/naphtha. The three component mixtures containing cyclohexane do not possess the solvation ability of cyclohexane, alone, but exhibit good solvating ability coupled with a higher flashpoint.

EXAMPLE 2

A 687 foot flowline in West Texas was plugged solid with paraffin. Three joints of the flowline were disconnected from the wellhead and the solid paraffin plug was physically removed. The joints were reconnected to the flowline, equipped with a valve and filled with a solvent mixture of toluene/naptha (50/50). The well was started, the line was pressured to 800 psi and the well was shut down. After 1½ hours, the pressure decreased to 300 psi and the well was used to repressurize the line to 550 psi. After another hour, the pressure decreased to 225 psi. The well was restarted, at which time the obstruction was broken through and the pressure on the flowline decreased to 60 psi. The solvent was thereafter injected into the flowline at the rate of one gallon per day. After two weeks, the pressure remained at 60 psi.

EXAMPLE 3

A number of wells in West Texas were experiencing production decreases due to paraffin plugging. Flushing with hot oil failed to resolve the paraffin problem. Ten gallons of a solvent mixture to toluene/naphtha (50/50) were pumped into each well. The next day, one well showed a 50% increase in production. All of the other wells showed an increase in production which, without continuing treatment, declined over a two week period to former levels. The wells are now treated with six gallons of solvent per month and no further paraffin problems have been encountered.

EXAMPLE 4

Paraffin bottoms had accumulated to a depth of 14 inches in a 250 barrel oil sales tank. Five gallons of a solvent mixture of toluene/naphtha (50/50) were added to the empty tank, the tank was filled with oil and circulated. Within a short time the bottoms were completely dissolved.

In a similar situation, the toluene/naphtha mixture (5 gallon) was added to a tank filled with oil and the contents of the tank were circulated. Within a short time the paraffin bottoms had completely dissolved.

EXAMPLE 5

Two five hundred barrel tanks of crude had accumulated 17 inches of paraffin bottoms. Five gallons of a mixture of toluene/naphtha (50/50) were added to each tank. The next day the bottom had completely dissolved.

EXAMPLE 6

A producing oil well was encountering flow problems because of 250 psi flowline pressure due to paraffin blockage. Four gallons of a mixture of toluene/naphtha (50/50) were added in the casing annulus. After two hours, the flowline pressure was reduced to 50 psi.

Although Examples 2–6 illustrate the invention with a toluene/naphtha solvent composition and represent the best mode of practicing the invention, it is to be understood that the invention is not to be limited thereby. The invention relates to aromatic/non-aromatic solvent compositions in general and it is considered that other aromatic/non-aromatic solvent systems such as cumene/naphtha, xylene/naphtha, toluene/cyclohexane, toluene/cyclooctane and the like would perform in an equivalent manner in the above Examples.

In another aspect of the invention, it has been found that the addition of a surfactant is helpful in dispersing the paraffin materials in solution in the solvent composition of the invention.

Surfactants which may be added to the solvent composition include cationic, anionic and nonionic surfactants such as alkoxylated alkyl phenols, alkyl benzene sulfonates, alkoxylated amines, quaternary amines and the like.

The concentration of surfactant which may be added to the solvent composition may be from about 1% to about 25%, preferably from about 5% to about 12%, especially from about 8% to about 10%.

Typical solvent/surfactant compositions which have been found useful include toluene (45 wt.%)/VM & P naphtha (45 wt.%)/salts of dodecyl benzene sulfonic acid (10 wt.%).

EXAMPLE 7

A large pipeline company had a 110,000 bbl. storage tank out of service for five months. The tank had developed a three foot bottom of paraffin and iron sulfide solids.

The tank was drained down to three feet of oil on top of three feet of bottoms. A drum of toluene/VM & P naphtha (50/50) and a drum of an alkoxylated phenol-/aldehyde resin surfactant were batched into the top of the tank. The mixers were then started and allowed to run for two days. Five feet of oil were then added to the tank, the booster pump was started and the entire contents of the tank was pumped out, leaving essentially no bottoms.

EXAMPLE 8

Experiments were run that establish that a solvent having a relatively high ratio of aromatic to alkane as contemplated in the present invention is surprisingly and markedly superior in terms of dissolving paraffin as compared to a solvent having the relatively high ratio of alkane to aromatic as contemplated by Rollo et al (U.S. Pat. No. 3,718,586).

In these experiments, various solvents and solvent combinations were tested to determine their Solvent Index @38° C. In the following table, the results of these experiments have been set forth.

TABLE II

| Test No. | Solvent | Weight Ratio | Solvent Index @ 38° C., Grams Wax per 100 Grams Solvent |
|---|---|---|---|
| 1 | Pentane (alone) | — | 9.1 |
| 2 | Toluene (alone) | — | 8.8 |
| 3 | Pentane/Toluene | 1:1 | 13.5 |
| 4 | Pentane/Toluene | 250:1 | 9.1 |
| 5 | Pentane/Toluene | 100:1 | 9.1 |

From the data of Table II, it can be noted that when the solvent mixture of pentane and toluene is present in a ratio of 1:1 (the general range contemplated by the process of the present invention), the mixture of solvents dissolves a much larger amount of paraffin as compared to either pentane or toluene taken alone or taken together in ratios of 250:1 and 100:1 (the general range contemplated by the Rollo et al patent). Specifically, with the ideal range of alkane to aromatic of 250:1 as taught by Rollo et al, one is able to dissolve only 9.1 grams of paraffin in 100 grams of such combination of solvents. However, with the 1:1 mixture of alkane to aromatic as contemplated in the present application, one is able to dissolve 13.5 grams of paraffin in 100 grams of such combination of solvents or about 48% more paraffin.

Additional experiments were conducted with various other solvents and solvent combinations over a wide range of weight ratios. The solvent index for these additional solvents and solvent combinations were determined in the manner as described, above. In the following table, the results of these experiments have been set forth:

TABLE III

| Test No. | Solvent | Weight Ratio | Solvent Index @ 38° C., Grams Wax per 100 Grams Solvent |
|---|---|---|---|
| 6 | Pentane (alone) | — | 9.1 |
| 7 | Toluene (alone) | — | 8.9 |
| 8 | Pentane/Toluene | 1:3 | 13.5 |
| 9 | Pentane/Toluene | 1:2 | 13.7 |
| 10 | Pentane/Toluene | 1:1 | 13.7 |
| 11 | Pentane/Toluene | 2:1 | 13.3 |
| 12 | Pentane/Toluene | 3:1 | 13.3 |
| 13 | Naphtha (alone) | — | 9.4 |
| 14 | Toluene (alone) | — | 8.9 |
| 15 | Naphtha/Toluene | 1:9 | 10.0 |
| 16 | Naphtha/Toluene | 1:4 | 11.4 |
| 17 | Naphtha/Toluene | 1:3 | 11.7 |
| 18 | Naphtha/Toluene | 1:2 | 11.7 |
| 19 | Naphtha/Toluene | 1:1 | 11.7 |
| 20 | Naphtha/Toluene | 2:1 | 11.0 |
| 21 | Naphtha/Toluene | 3:1 | 10.4 |
| 22 | Naphtha/Toluene | 4:1 | 10.4 |
| 23 | Naphtha/Toluene | 9:1 | 10.3 |

TABLE III-continued

| Test No. | Solvent | Weight Ratio | Solvent Index @ 38° C., Grams Wax per 100 Grams Solvent |
|---|---|---|---|
| 24 | Naphtha (alone) | — | 9.4 |
| 25 | Xylene (alone) | — | 8.7 |
| 26 | Naphtha/Xylene | 1:3 | 10.8 |
| 27 | Naphtha/Xylene | 1:2 | 10.8 |
| 28 | Naphtha/Xylene | 1:1 | 11.5 |
| 29 | Naphtha/Xylene | 2:1 | 11.3 |
| 30 | Naphtha/Xylene | 3:1 | 10.8 |
| 31 | Naphtha (alone) | — | 9.4 |
| 32 | Mesitylene (alone) | — | 8.6 |
| 33 | Naphtha/Mesitylene | 1:3 | 10.0 |
| 34 | Naphtha/Mesitylene | 1:2 | 10.0 |
| 35 | Naphtha/Mesitylene | 1:1 | 10.2 |
| 36 | Naphtha/Mesitylene | 2:1 | 10.0 |
| 37 | Naphtha/Mesitylene | 3:1 | 9.6 |

From the data in Table III, it can be noted that when the tested solvent mixture is present over a range of weight ratios, the mixtures of solvents dissolve a significantly larger amount of paraffin as compared to the solvents when used by themselves.

While the illustrative embodiments of the invention have been described with particularity, it will be understood that various other modifications will be apparent to and can be readily made by those skilled in the art to which the invention pertains without departing from the spirit and scope of the invention. Accordingly, it is not intended that the scope of the claims appended hereto be limited to the examples and descriptions set forth herein but rather that the claims be construed as encompassing all of the features of patentable novelty which reside in the present invention, including all features which would be treated as equivalents thereof by those skilled in the art to which the invention pertains.

What is claimed is:

1. Process of removing flow obstructing paraffin and paraffin-like deposits from oilfield equipment comprising flushing said equipment with a solvent mixture comprising an aromatic hydrocarbon selected from the group consisting of toluene, xylene, mesitylene and mixtures thereof and petroleum naphtha, the weight ratio of said aromatic hydrocarbon to naphtha being about 10/90 to about 90/10.

2. Process of claim 1 wherein the aromatic hydrocarbon is toluene.

3. Process of claim 1 wherein said solvent mixture contains a minor amount of a surfactant.

4. Process of claim 1 wherein the weight ratio of the aromatic hydrocarbon to naphtha being about 40/60 to about 60/40.

5. Process of claim 4 wherein the aromatic hydrocarbon is toluene.

6. Process of claim 4 wherein the aromatic hydrocarbon is xylene.

7. Process of claim 4 wherein the aromatic hydrocarbon is mesitylene.

8. Process of claim 4 wherein said solvent mixture contains a minor amount of a surfactant.

9. Process of claim 5 wherein the weight ratio of toluene to naphtha is about 50/50.

* * * * *